United States Patent [19]

Wenman

[11] Patent Number: 4,472,767

[45] Date of Patent: Sep. 18, 1984

[54] REFLECTOR ASSEMBLY FOR INDIRECT OR SEMI-INDIRECT LIGHTING FIXTURE

[75] Inventor: James A. Wenman, Kenosha, Wis.

[73] Assignee: McGraw-Edison Company, Rolling Meadows, Ill.

[21] Appl. No.: 333,737

[22] Filed: Dec. 23, 1981

[51] Int. Cl.[3] ..... F21V 7/00

[52] U.S. Cl. ..... 362/302; 362/147; 362/263; 362/367

[58] Field of Search ..... 362/147, 263, 362, 367, 362/302, 310

[56] References Cited

U.S. PATENT DOCUMENTS

| | | | |
|---|---|---|---|
| 1,612,300 | 12/1926 | Manookin | 362/303 |
| 2,149,109 | 2/1939 | Welch | 362/303 |
| 4,186,433 | 1/1980 | Baldwin | 362/263 |

*Primary Examiner*—Donald P. Walsh

*Attorney, Agent, or Firm*—Charles W. MacKinnon; Jon Carl Gealow; Ronald LaPorte

[57] ABSTRACT

A reflector assembly for an indirect or semi-indirect, ceiling supported lighting fixture includes a reflector housing having a top wall comprising a main reflective surface, the main reflective surface being sloped predeterminedly downwardly and inwardly from the housing perimeter to a central aperture defined in the main reflective surface. A high-intensity discharge lamp is predeterminedly positioned in the central aperture for directing light toward the reflective surface from which the light is reflected upwardly toward the ceiling support. A second cup-shaped reflector is positioned beneath the main reflective surface in alignment with the central aperture and in surrounding relation with respect to the lamp. The cup-shaped reflector is spaced slightly from the main reflective surface to define a gap therebetween. The lower wall of the housing includes a translucent panel which is illuminated by light from the lamp passing through the gap.

14 Claims, 3 Drawing Figures

REFLECTOR ASSEMBLY FOR INDIRECT OR SEMI-INDIRECT LIGHTING FIXTURE

BACKGROUND OF THE INVENTION

This invention relates generally to indoor lighting fixtures employing high-intensity discharge lamps, which lighting fixtures are adapted to be mounted on a ceiling for producing semi-indirect or indirect lighting and more particularly to a reflector assembly therefor.

Since the introduction of high-intensity discharge lamps, greater use of such lamps has been made indoors. The last-mentioned lamps have found favor in school rooms, office and the like environs, since with the relatively high lumens per watt output of the lamps, fewer fixtures need be employed to achieve desired illumination.

Becasue the brightness of high-intensity discharge lamps is so great, however, these lamps are not well suited for use in conventional, direct illumination type indoor lighting fixtures. Instead, such lamps have been employed for indoor use in indirect or semi-indirect lighting fixtures. Examples of lighting fixtures of the last-mentioned type are illustrated in U.S. Pat. Nos. 3,950,638; 4,186,433; and 4,280,170. Each of the aforementioned patents illustrates a lighting fixture employing a high-intensity discharge lamp which is mounted in a socket arrangement suspended from the ceiling of a room. The vertically downwardly extending lamp is surrounded at its free end by a reflector arrangement which reflects light emitted from the lamp onto the ceiling surrounding the fixture which, in turn, illuminates an area of the room. The aforementioned patents illustrate a variety of reflector arrangements to accomplish the latter.

The provision of indirect or semi-indirect lighting fixtures for use indoors is itself not new. The prior art also reveals indirect lighting fixtures employed prior to the advent of high-intensity discharge lamps. Examples of those lighting fixtures are illustrated in U.S. Pat. Nos. 990,400; 1,966,583; and 2,136,862.

While the reflector arrangements of the last-mentioned patents are designed to reflect light from an incandescent lamp upwardly for illuminating an area of a room indirectly, such reflector arrangements have obviously not been designed for and appear that they would not, in most cases, be suitable for nor optimize the light output of a high-intensity discharge lamp.

SUMMARY OF THE INVENTION

Accordingly, it is a primary object of the present invention to provide a new and improved reflector assembly for use in a semi-indirect or indirect indoor lighting fixture employing a high-intensity discharge lamp.

It is another object of the present invention to provide a reflector assembly of the aforementioned type which optimizes light output from the lighting fixture while minimizing glare.

It is still another object of the present invention to provide a reflector assembly of the aforementioned type which is highly efficient, maximizes lamp life, and is relatively simple in construction.

Briefly, a preferred embodiment of the reflector assembly according to the invention, includes a reflector housing including a top wall comprising a main or primary reflector having an upwardly facing surface of high specular reflective material. The reflector housing is preferably cylindrical with the main reflector taking the shape of a shallow, inverted, truncated, right angle cone.

A central aperture is defined in the main reflector and the reflector surface is sloped predeterminedly downwardly from the perimeter of the housing and inwardly toward the outer edge of the central aperture. The slope of the surface is approximately 10 degrees.

A high-intensity discharge lamp having a predetermined arc length extends vertically downwardly into the reflector housing through the central aperture of the main reflector. The upper edge of the arc of the lamp is located slightly horizontally below the peripheral edge of the main reflector, while the lower edge of the arc of the lamp is located slightly horizontally above the edge of the central aperture of the main reflector. The location of the lamp with respect to the main reflector causes light rays emanating from the lamp to fall incident on the main reflector reflective surface. From there, the light is reflected upwardly and outwardly toward the ceiling from which the lighting fixture is suspended.

A secondary, cup-shaped reflector, also having a reflective surface of high specular reflective material, surrounds the lower end of the lamp and is aligned vertically with the central aperture of the main reflector. Light from the lamp arc emitted downwardly past the main reflector falls incident on the reflective surface of the cup-shaped reflector and is reflected upwardly and outwardly past the lamp onto the surrounding ceiling. The reflective surface of the cup-shaped reflector is fluted to minimize the passage of reflected light rays directly through the arc of the lamp, thereby minimizing overheating of the lamp.

The upper edge of the cup-shaped, secondary reflector is spaced slightly from the lower surface of the main reflector to permit light rays from the lamp to pass therebetween into the lower portion of the reflector housing. The lower wall of the reflector housing includes a translucent lens or panel which, when struck by light rays is illuminated. The illumination of the lower wall of the housing eliminates the appearance of a "dark spot" at the bottom of the lighting fixture when hung from the ceiling in a room.

A third cylindrical reflector mounted within the reflector housing is separated from the cup-shaped reflector and acts to reflect light rays passing into the housing through the space between the main and secondary reflectors, onto the translucent lower wall of the reflector housing for illumination thereof.

DETAILED DESCRIPTION OF THE DRAWINGS

Figure 1:
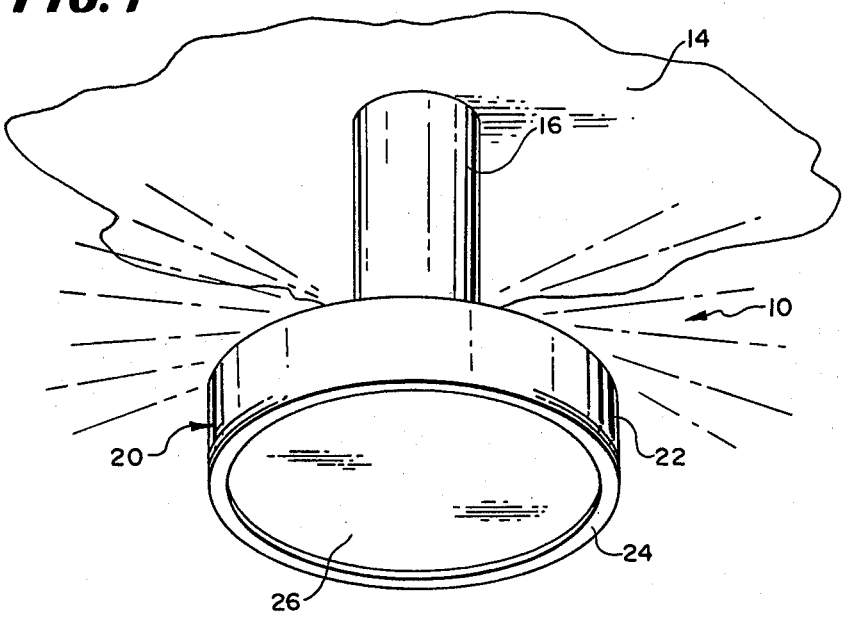
FIG. 1 is a perspective view of an indoor, semi-indirect lighting fixture employing a high-intensity discharge lamp, which fixture includes a new and improved reflector assembly according to the invention.

Referring now to the drawings in greater detail wherein like numerals have been employed throughout the figures to designate similar components, a semi-indirect lighting fixture designated generally by the numberal 10, employing a reflector assembly 12 according to the invention, is shown suspended from the ceiling 14 of a room to be illuminated by the lighting fixture.

Lighting fixture 10 illustrated in the drawings includes a tubular support member 16 attached in a conventional manner to ceiling 14 at a source of electrical power (not shown). Included as a part of tubular member 16, but not shown, is a conventional electrified socket designed to receive a high-intensity discharge lamp 17 of the type shown in FIGS. 2 and 3. High-intensity discharge lamp 17 is a high lumens per watt output metal halide or high pressure sodium vapor lamp having a vertically oriented arc of a predetermined length, illustrated in FIG. 3 by the numeral 18. Lamp 17 extends vertically downwardly from tubular member 16.

Attached at the lower, free end of tubular member 16 is a reflector housing 20 included as a part of reflector assembly 12 according to the invention. In the lighting fixture illustrated, reflector housing 20 is cylindrically shaped, but can take other shapes as well and still fall within the scope of the present invention.

Reflector housing 20 includes an outer side wall 22 and a lower or bottom wall 24 joined thereto. A center section of lower wall 24 comprises a removeably mounted translucent panel 26 formed of plastic or similar material. In the embodiment of housing 20 shown in FIG. 3, tabs 28 formed on translucent panel 26 at the perimeter thereof, snap into aligned apertures 30 defined in lower wall 24. Other suitable means for fastening the translucent panel 26 on lower wall 24 may be employed as well.

Figure 2:
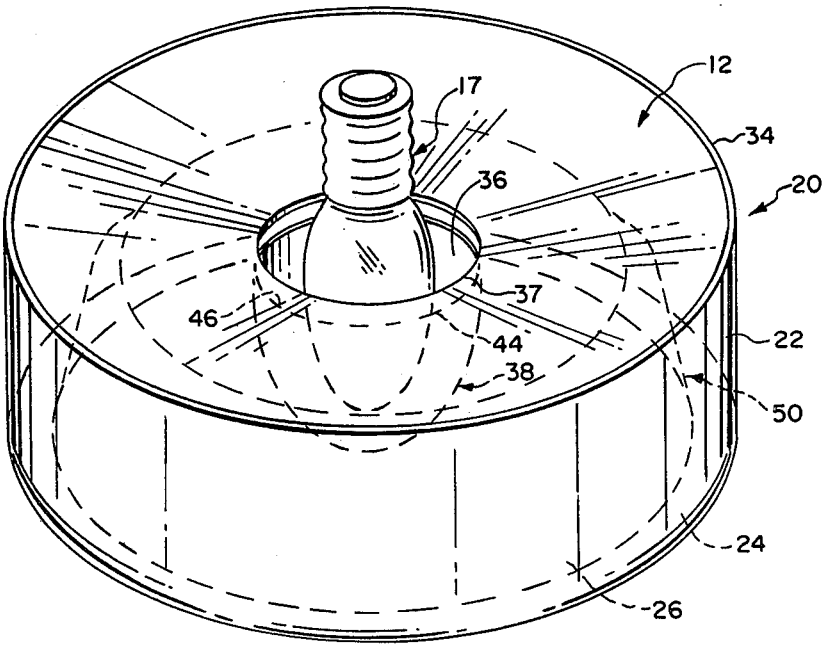
FIG. 2 is a perspective view of the new and improved reflector assembly included in the lighting fixture of FIG. 1.
Figure 3:
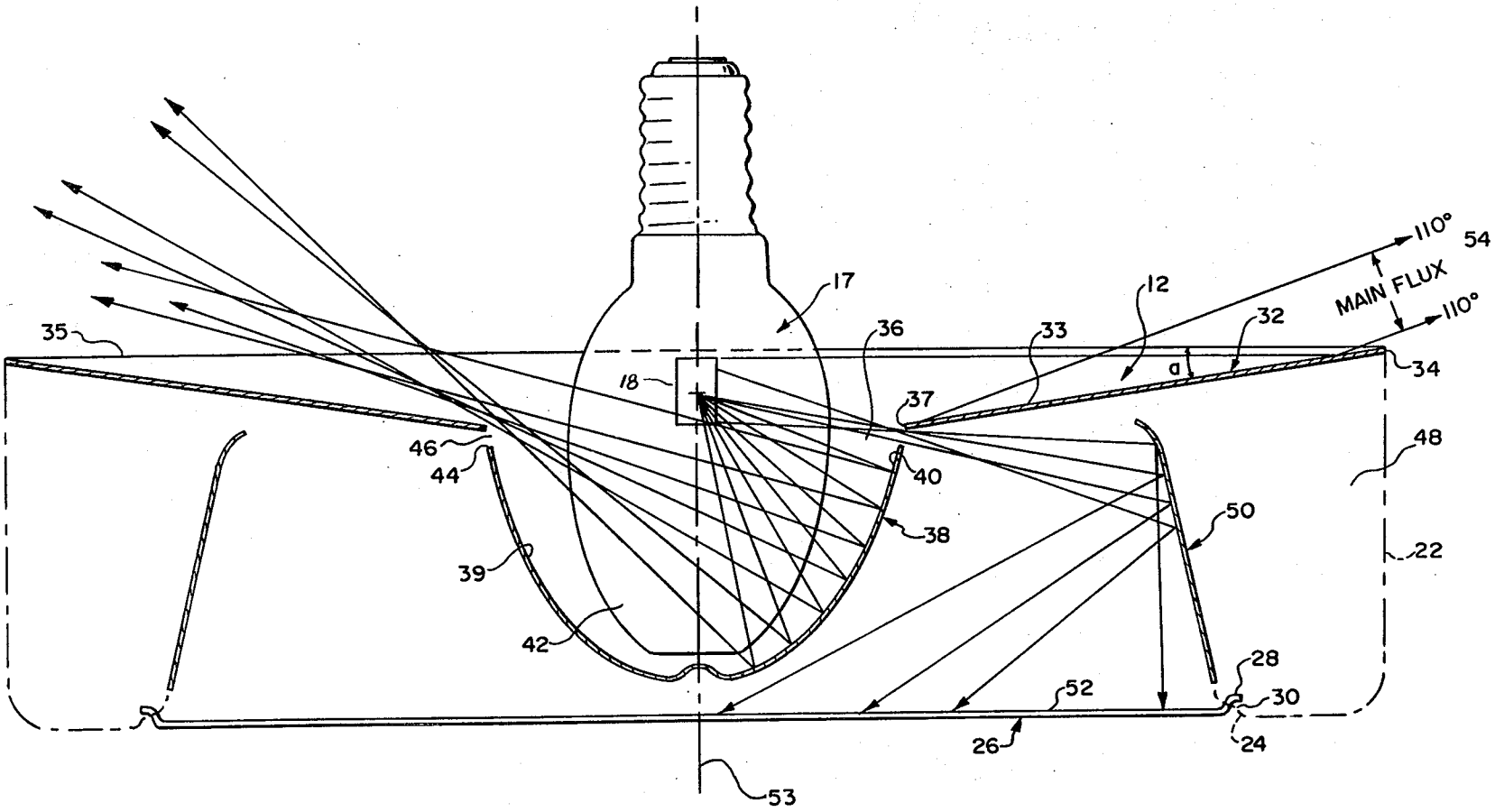
FIG. 3 is an enlarged, sectional view of the reflector assembly of FIG. 2.

Reflector assembly 12, according to the invention, further includes a main or primary reflector 32 defining the upper wall of reflector housing 20. Main reflector 32 has the shape of a shallow, inverted, truncated, right angle cone with an outer peripheral edge or perimeter 34 and a central, circular aperture 36 into which high-intensity discharge lamp 17 is received (FIGS. 2 and 3).

The upper surface 33 of main reflector 32 is formed of high specular reflective material. The reflective surface slopes inwardly and downwardly from the peripheral edge of reflector 32 toward the edge of central aperture 36. The slope of reflective surface 33 as selected for a particular lighting fixture, is dependent upon the length of arc 18 of lamp 17 and the diameter or width of main reflector 32. Also considered is the distance the reflector is suspended from ceiling 14.

In practice, arc lengths of high-intensity discharge lamps vary from about ¾ of an inch in the case of a 175 W. metal halide lamp to about 3½ inches in the case of a 400 W. high pressure sodium lamp. Semi-indirect lighting fixtures of the type shown will provide efficient lighting with the reflector housing hung so that the center of the arc of the lamp is from 8 inches to 4 feet from the ceiling. In the last-mentioned cases, the angle of the slope of the main reflective surface also may vary from about 45 degrees to 10 degrees from the horizontal (see angle "a", FIG. 3). The greater the slope of the main reflective surface, the smaller the area of illumination striking ceiling 14.

When high-intensity discharge lamp 17 is received in central aperture 36 of main reflector 32, the highest vertical point of arc 18 of the lamp is positioned horizontally slightly below peripheral edge 34 of main reflector 32 and the lowest vertical point of arc 18 of lamp 17 is positioned horizontally slightly above edge 37 of central aperture 36. The positioning of high-intensity discharge lamp 17 as described, ensures a maximum amount of light emanating from lamp 17 to be reflected from reflective surface 33 onto the surrounding ceiling and also eliminates unwanted glare from direct light rays from the lamp.

It has been found that for illuminating an average room with conventional 8 foot ceiling height, a reflector housing including a reflector assembly according to the invention should be suspended about 1 foot from the ceiling with the lamp arc center being at about 9½ to 10 inches from the ceiling. Using a typical 175 watt metal halide, high-intensity discharge lamp with an arc length of about ¾ of an inch, and with a reflector diameter of about 16 inches, the slope of the main reflective surface, i.e., angle "a", is preferably about 10 degrees measured from horizontal line 35 extending through peripheral edge 34 of reflector 32 (FIG. 3).

In addition to the main reflector, a secondary, cup-shaped reflector 38 having an internal surface 39 of highly specular reflective material, is mounted within the interior 48 of reflector housing 20, directly beneath and aligned with central aperture 36 in the main reflector. The open end 40 of reflector 38 is positioned to receive the free end 42 of lamp 17 therein. Upper edge 44 of reflector 38 is positioned slightly below main reflector 32, defining a gap or slit 46 between the reflectors. Slit 46 permits light from lamp 17 to pass between the reflectors into the interior 48 of reflector housing 20. Interior surface 39 of secondary reflector 38 is fluted to minimize the passage of light reflected therefrom through arc 18 of lamp 17, thereby to also minimize heat build-up in the lamp.

A third reflector 50 is mounted within housing 20 in surrounding relation with respect to reflector 38, but spaced therefrom. In the embodiment of reflector assembly 12 shown in the drawings, reflector 50 is cylindrical or ring shaped. Reflector 50 in the lighting fixture shown, parallels the perimeter of translucent panel 26. The purpose of reflector 50 is to reflect light from lamp 17 passing through slit 46, onto surface 52 of translucent panel 26, thereby to illuminate the panel and prevent the appearance of a "dark spot" along lower wall 24 of the lighting fixture. The size of slit 46 is chosen to permit an amount of light into housing 20 to illuminate panel 26 sufficiently to appear to be of equal brightness as the ceiling onto which light from the main reflector is reflected.

A lighting fixture of the type illustrated in the drawings typically includes a main reflector diameter of about 16 inches and a downward and inward slope of surface 33 thereof of about 10 degrees. Using a 175 watt high-intensity discharge lamp having an arc length of about ¾ inches and with the fixture being suspended so that the arc 18 of lamp 17 is approximately 10 inches from the ceiling, a predominant circular light pattern of about 10 feet in diameter is provided on the ceiling surface upon which the lighting fixture is mounted. Main, parallel light rays or flux, designated 54, are reflected at an angle of about 110 degrees from a vertical line 53 passing through arc 18 of lamp 17. If the angle of the slope of main reflective surface 33 were increased, for example, to 30 degrees from the horizontal, the area of illumination on the ceiling surface would decrease accordingly, as would the angle of reflection of main flux 54.

Secondary light reflected from cup-shaped reflector 38 also strikes the ceiling surface. Such rays are, however, not parallel, as illustrated in FIG. 3.

As described heretofore, certain of the light rays from lamp 17 pass through the gap or slit 46 between the main and cup-shaped reflectors. These rays strike reflector 50 and thereafter fall on translucent panel 26 for illumination thereof. This prevents the appearance of a "dark spot" when looking at the lighting fixture when mounted on a ceiling in a room.

While a particular embodiment of the invention has been shown and described, it should be understood that the invention is not limited thereto since many modifications may be made. It is, therefore, contemplated to cover by the present application any and all such modifications as fall within the true spirit and scope of the appended claims.

I claim:

1. A lighting fixture adapted to be suspended from a ceiling surface for indirectly illuminating a predetermined area of a room, said fixture including a high-intensity discharge lamp and a reflector assembly for reflecting light rays emanating from said lamp onto said ceiling surface, said reflector assembly comprising: reflector housing means having a predetermined dimension and including top, bottom, and side walls joined together to define an enclosed interior, said top wall comprising a main reflector with an upwardly facing reflective surface, said main reflector having a peripheral edge and defining a central aperture, said discharge lamp being received in said central aperture and extending into said housing means, said reflective surface being sloped predeterminedly downwardly and inwardly from said peripheral edge, toward said central aperture for reflecting light from said lamp onto a predetermined area of said ceiling surface, said reflector assembly further including a cup-shaped reflector means mounted within the interior of said relector housing means in alignment with said central aperature of said main reflector, said cup-shaped reflector means having a reflective surface surrounding the free end of said discharge lamp for reflecting light rays from said discharge lamp passing through said central aperture onto said ceiling surface, said cup-shaped reflector means being spaced predeterminedly from said main reflector to define a gap therebetween, said discharge lamp being predeterminedly positioned in said central aperture to permit a portion of the light emanating from said discharge lamp to pass through said gap into the interior of said housing means and whereby said lower wall of said housing means includes a translucent panel, said panel being illuminated by said light passing through said gap into said interior of said housing means.

2. A lighting fixture as claimed in claim 1 wherein said reflective surface is sloped downwardly at an angle of 10–45 degrees from a horizontal line passing through said peripheral edge of said reflector.

3. A lighting fixture as claimed in claim 1, wherein the reflective surface of said cup-shaped reflector means is fluted to minimize the passage of light rays reflected therefrom back through said discharge lamp.

4. A lighting fixture as claimed in claim 1, further including reflector means mounted within the interior of said housing means in surrounding relation with respect to said cup-shaped reflector means, said first-mentioned reflector means reflecting light passing into said interior of said housing means onto said translucent panel for illumination thereof.

5. A lighting fixture as claimed in claim 2, wherein said housing means is cylindrically shaped, wherein said main reflector has the shape of an inverted, truncated, right angle cone and wherein said central aperture defined therein is circular.

6. A lighting fixture as claimed in claim 2, wherein said discharge lamp includes a vertically disposed arc having a predetermined length and wherein said lamp is received in said central aperture to position the highest vertical point of said arc horizontally, slightly below the peripheral edge of said reflective surface of said main reflector and the lowest vertical point of said arc, slightly above the reflective surface of said main reflector defining said central aperture, whereby light emanating from said lamp directed towards said reflective surface of said main reflector is reflected in parallel rays therefrom toward said ceiling surface.

7. A reflector assembly for an indirect lighting fixture adapted to be suspended from a support surface, said lighting fixture including a downwardly extending high-intensity discharge lamp, said discharge lamp having a vertically extending arc of a predetermined length, said reflector assembly including cup-shaped reflector means and housing means said housing means comprising top, side, and bottom walls joined to define an enclosed interior, said top wall comprising a main reflective surface having a central aperture defined therein, said reflective surface sloping from the periphery thereof downwardly and inwardly towards said central aperture, the free end of said high-intensity discharge lamp being predeterminedly received in said central aperture to position the highest vertical point of said lamp arc horizontally, slightly below the peripheral edge of said reflective surface and the lowest vertical point of said lamp arc horizontally, slightly above the edge of said reflective surface defining said central aperture, whereby light rays from said lamp directed to said reflective surface are reflected in parallel rays therefrom onto said support surface, said cup-shaped reflector means being spaced predeterminedly from said main reflector to define a gap therebetween, said discharge lamp being predeterminedly positioned in said central aperture to thereby permit the light from said lamp to pass through said gap into the interior of said housing means and said lower wall of said housing means including a translucent panel, said panel being illuminated by the light passing through said gap into said interior of said housing means.

8. A reflector assembly as claimed in claim 7, wherein the angle of the slope of said main reflective surface is greater than 10 degrees, but less than 45 degrees with respect to a horizontal line passing through said peripheral edge.

9. A reflector assembly as claimed in claim 8, wherein said housing means is cylindrical in shape and said main reflective surface has the shape of an inverted, truncated, right angle cone, defining a central circular aperture therein.

10. A reflector assembly as claimed in claim 9, further including ring-shaped reflector means mounted within the interior of said housing means in surrounding relation with respect to said cup-shaped reflector means, said ring-shaped reflector means reflecting light passing through said gap into the interior of said housing means, onto said translucent panel.

11. A reflector assembly for an indirect lighting fixture adapted to be suspended from a support surface, said lighting fixture including a downwardly extending high-intensity discharge lamp, said reflector assembly including a cup-shaped reflector means and housing means surrounding and enclosing said cup-shaped reflector means, said housing means comprising top, side and bottom walls joined to define an enclosed interior, said top wall comprising a conical reflector, said conical reflector having the shape of an inverted, truncated right angle cone, said reflector including an upwardly facing reflective surface and defining a central aperture therein, said discharge lamp being received in said central aperture for directing light onto said reflective surface of said conical reflector said light being reflected by said reflective surface onto said support surface, said cup-shaped reflector means being mounted beneath said conical reflector, in alignment with said central aperture, and surrounding the free end of said discharge lamp for reflecting light from said lamp passing through said central aperture back toward said support surface, said bottom wall of said housing including a translucent panel, and wherein said cup-shaped reflector means is spaced slightly from said conical reflector to provide a gap therebetween, said discharge lamp being predeterminedly positioned in said central aperture to permit a predetermined amount of light from said lamp to pass through said gap to thereby illuminate said translucent panel.

12. A reflector assembly as claimed in claim 11, wherein said reflective surface is sloped downwardly and inwardly from the peripheral edge of said reflective surface forward said central aperture, the angle of said slope being between 10–45 degrees taken from a horizontal line passing through said peripheral edge.

13. A reflector assembly as claimed in claim 12, wherein the angle of the slope of said reflective surface is approximately 10 degrees.

14. A reflector assembly as claimed in claim 11, wherein said high-intensity discharge lamp includes a vertically extending lamp arc of a predetermined length and wherein said lamp is received in said central aperture of said reflector to position the highest vertical point of said lamp arc horizontally, slightly below the peripheral edge of said reflective surface of said reflector and the lowest vertical point of said lamp arc horizontally, slightly above the edge of said reflective surface of said reflector defining said central aperture.

* * * * *